US010016324B1

(12) United States Patent
Howard

(10) Patent No.: US 10,016,324 B1
(45) Date of Patent: Jul. 10, 2018

(54) WALKER

(71) Applicant: JKHOW LIMITED LIABILITY COMPANY, McGregor, TX (US)

(72) Inventor: Jesse Linn Howard, McGregor, TX (US)

( * ) Notice: Subject to any disclaimer, the term of this patent is extended or adjusted under 35 U.S.C. 154(b) by 0 days.

(21) Appl. No.: 15/466,426

(22) Filed: Mar. 22, 2017

(51) Int. Cl.
*A61G 5/14* (2006.01)
*A61H 3/00* (2006.01)
*A61H 3/04* (2006.01)

(52) U.S. Cl.
CPC ..... *A61G 5/14* (2013.01); *A61H 3/00* (2013.01); *A61H 3/04* (2013.01); *A61H 2201/164* (2013.01)

(58) Field of Classification Search
CPC ... A61G 5/14; A61H 3/00; A61H 3/04; A61H 2201/164
USPC ..... 135/67
See application file for complete search history.

(56) References Cited

U.S. PATENT DOCUMENTS 2,627,904 A * 2/1953 Thieman ..... A61H 3/00 135/67
3,591,874 A * 7/1971 O'Kennedy ..... A61G 7/1038 135/67
4,474,202 A * 10/1984 Blechner ..... A61H 3/00 135/67
4,884,587 A * 12/1989 Mungons ..... A61H 3/00 135/65
7,363,931 B2 * 4/2008 Weaver ..... A61G 7/1038 135/66
8,172,023 B1 * 5/2012 Irvine ..... A61G 5/128 135/66
8,544,486 B1 * 10/2013 Hardwick ..... A61H 3/00 135/67
8,919,362 B1 * 12/2014 Mortenson ..... A45B 9/04 135/66
9,763,839 B2 * 9/2017 Morris ..... A61H 3/00
2003/0151232 A1 * 8/2003 Li ..... A61G 5/08 280/648

* cited by examiner

*Primary Examiner* — Noah Chandler Hawk

(57) ABSTRACT

An improved walker is disclosed. The walker may include a left frame spaced apart from a right frame and connected by at least one horizontal connecting member. The lower portion of each of the left and right frames includes a foot platform that is rotatably mounted and moveable between a retracted position and an engaged position, in which the foot platform is in contact with and resting on a floor surface. In use, a person may use the walker to assist the person rising from a sitting position to a standing position so that the person can then proceed to use the walker to assist the person in walking.

14 Claims, 7 Drawing Sheets

WALKER

BACKGROUND OF THE INVENTION

1. Field of the Invention

The present inventions generally pertain to devices for assisting invalids, the elderly, the disabled and others who need assistance with their mobility, and more particularly to an improved walker to assist individuals in moving from a sitting position to a standing position to use a walker.

2. Description of the Related Art

A variety of devices exist for assisting the people with their mobility, examples of which include wheel chairs and walkers. Conventional walkers include two side frames (one on the left and one on the right) that are connected together by a front support member. Each of the side frames includes a horizontal bar about waist high. In use, an elderly or other person in need of walking assistance, once in the standing position, places one hand on each of the horizontal bars on the side frames and uses those bars as support as the person takes steps. The walker may have wheels to assist the user of the walker in moving the walker along the floor as the person takes steps.

One of the problems with conventional walkers is that the person needing to use the walker may experience difficult in rising from the sitting position to the standing position to use the walker. As the person is sitting down and grasps the handle bars of the walker, the walker may tip backwardly toward the user when the user attempts to pull himself or herself up by using the handle bars. Others have attempted to solve this problem (e.g., U.S. Pat. No. 4,474,202 to Blechner), but those attempts are considered to be of inferior design and lacking in being user friendly.

As will become apparent from the following descriptions and discussion, the present inventions are directed to an improved walker that can be efficiently and comfortably used to assist an invalid or other person in rising from a sitting position to a standing position.

SUMMARY OF THE INVENTION

An improved walker is disclosed. In one aspect, an embodiment of the present inventions may include an improved walker comprising: a left frame including a left rear vertical leg having an upper end and a lower end, a left forward vertical leg having an upper end and lower end, a left horizontal handle bar connecting the upper end of the left rear vertical leg to the upper end of the left forward vertical leg, and a left rotatable foot platform connected between the lower end of the left rear vertical leg and the lower end of the left forward vertical leg and moveable between a retracted position and a lower position; and a right frame including a right rear vertical leg having an upper end and a lower end, a right forward vertical leg having an upper end and lower end, a right horizontal handle bar connecting the upper end of the right rear vertical leg to the upper end of the right forward vertical leg, and a right rotatable foot platform connected between the lower end of the right rear vertical leg and the lower end of the right forward vertical leg and moveable between a retracted position and a lower position. Another feature of this aspect of the present inventions may be that the improved walker may further include a left support bar connected to the left frame and a right support bar connected to the right frame, the left foot platform being rotatably connected to the left support bar and the right foot platform being rotatable connected to the right support bar. Another feature of this aspect of the present inventions may be that the improved walker may further include a left spring and a right spring, the left spring being secured to the left support bar and to the left foot platform and adapted to urge the left foot platform into a normally retracted position, the right spring being secured to the right support bar and to the right foot platform and adapted to urge the right foot platform into a normally retracted position. Another feature of this aspect of the present inventions may be that the improved walker may further include a left forward shaft coupler connected to the left forward vertical leg and a left rear shaft coupler connected to the left rear vertical leg; a right forward shaft coupler connected to the right forward vertical leg and a right rear shaft coupler connected to the right rear vertical leg; a left support bar connected between the left forward shaft coupler and the left rear shaft coupler, the left foot platform being rotatably connected to the left support bar; and a right support bar connected between the right forward shaft coupler and the right rear shaft coupler, the right foot platform being rotatably connected to the right support bar. Another feature of this aspect of the present inventions may be that the improved walker may further include a left forward shaft bracket adjustably connected to the left forward shaft coupler and also connected to a forward end of the left support bar; a left rear shaft bracket adjustably connected to the left rear shaft coupler and also connected to a rear end of the left support bar; a right forward shaft bracket adjustably connected to the right forward shaft coupler and also connected to a forward end of the right support bar; and a right rear shaft bracket adjustably connected to the right rear shaft coupler and also connected to a rear end of the right support bar. Another feature of this aspect of the present inventions may be that the improved walker may further include a left spring and a right spring, the left spring being secured to the left support bar and to the left foot platform and adapted to urge the left foot platform into a normally retracted position, the right spring being secured to the right support bar and to the right foot platform and adapted to urge the right foot platform into a normally retracted position.

In another aspect, an embodiment of the present inventions may include an improved walker comprising: a left frame including a left rear vertical leg having an upper end and a lower end, a left forward vertical leg having an upper end and lower end, a left horizontal handle bar connecting the upper end of the left rear vertical leg to the upper end of the left forward vertical leg, a left rotatable foot platform connected between the lower end of the left rear vertical leg and the lower end of the left forward vertical leg and moveable between a retracted position and a lower position, and a left support bar connected to the left frame, the left foot platform being rotatably connected to the left support bar; and a right frame including a right rear vertical leg having an upper end and a lower end, a right forward vertical leg having an upper end and lower end, a right horizontal handle bar connecting the upper end of the right rear vertical leg to the upper end of the right forward vertical leg, and a right rotatable foot platform connected between the lower end of the right rear vertical leg and the lower end of the right forward vertical leg and moveable between a retracted position and a lower position, and a right support bar connected to the right frame, the right foot platform being rotatably connected to the right support bar. Another feature of this aspect of the present inventions may be that the improved walker may further include a left forward shaft coupler connected to the left forward vertical leg and a left rear shaft coupler connected to the left rear vertical leg, the left support bar being connected between the left forward shaft coupler and the left rear shaft coupler; and a right forward shaft coupler connected to the right forward vertical leg and a right rear shaft coupler connected to the right rear vertical leg, the right support bar being connected between the right forward shaft coupler and the right rear shaft coupler. Another feature of this aspect of the present inventions may be that the improved walker may further include a left forward shaft bracket adjustably connected to the left forward shaft coupler and also connected to a forward end of the left support bar; a left rear shaft bracket adjustably connected to the left rear shaft coupler and also connected to a rear end of the left support bar; a right forward shaft bracket adjustably connected to the right forward shaft coupler and also connected to a forward end of the right support bar; and a right rear shaft bracket adjustably connected to the right rear shaft coupler and also connected to a rear end of the right support bar. Another feature of this aspect of the present inventions may be that the improved walker may further include a left spring and a right spring, the left spring being secured to the left support bar and to the left foot platform and adapted to urge the left foot platform into a normally retracted position, the right spring being secured to the right support bar and to the right foot platform and adapted to urge the right foot platform into a normally retracted position.

In another aspect, an embodiment of the present inventions may include an assembly for attachment to a walker that includes a left frame and a right frame, the left frame including a left rear vertical leg having an upper end and a lower end, a left forward vertical leg having an upper end and lower end, a left horizontal handle bar connecting the upper end of the left rear vertical leg to the upper end of the left forward vertical leg, the assembly comprising: a left forward shaft coupler adapted for connection to the left forward vertical leg and a left rear shaft coupler adapted for connection to the left rear vertical leg; a left rotatable foot platform adapted for rotatable connection between the left forward shaft coupler and the left rear shaft coupler, and for movement between a retracted position and a lower position; a right forward shaft coupler adapted for connection to the right forward vertical leg and a right rear shaft coupler adapted for connection to the right rear vertical leg; and a right rotatable foot platform adapted for rotatable connection between the right forward shaft coupler and the right rear shaft coupler, and for movement between a retracted position and a lower position. Another feature of this aspect of the present inventions may be that the assembly may further include a left support bar adapted for connection between the left forward shaft coupler and the left rear shaft coupler, the left rotatable foot platform being adapted for rotatable connection to the left support bar; and a right support bar adapted for connection between the right forward shaft coupler and the right rear shaft coupler, the right rotatable foot platform being adapted for rotatable connection to the right support bar. Another feature of this aspect of the present inventions may be that the assembly may further include a left forward shaft bracket adjustably connected to the left forward shaft coupler and also adapted for connection to a forward end of the left support bar; a left rear shaft bracket adjustably connected to the left rear shaft coupler and also adapted for connection to a rear end of the left support bar; a right forward shaft bracket adjustably connected to the right forward shaft coupler and also adapted for connection to a forward end of the right support bar; and a right rear shaft bracket adjustably connected to the right rear shaft coupler and also adapted for connection to a rear end of the right support bar. Another feature of this aspect of the present inventions may be that the assembly may further include a left spring and a right spring, the left spring being for attachment to the left support bar and to the left foot platform and adapted to urge the left foot platform into a normally retracted position, the right spring being for attachment to the right support bar and to the right foot platform and adapted to urge the right foot platform into a normally retracted position. Another feature of this aspect of the present inventions may be that the left foot platform may include a forward arm and a rear arm, the forward arm of the left foot platform including an aperture adapted for receiving a forward end of the left support bar, and the rear arm of the left foot platform may include aperture adapted for receiving a rear end of the left support bar; and the right foot platform may include a forward arm and a rear arm, the forward arm of the right foot platform may include an aperture adapted for receiving a forward end of the right support bar, and the rear arm of the right foot platform including an aperture adapted for receiving a rear end of the right support bar.

Other features, aspects and advantages of the present inventions will become apparent from the following discussion and detailed description.

While the inventions will be described in connection with the preferred embodiments, it will be understood that the scope of protection is not intended to limit the inventions to those embodiments. On the contrary, the scope of protection is intended to cover all alternatives, modifications, and equivalents as may be included within the spirit and scope of the inventions as defined by the appended claims.

DETAILED DESCRIPTION OF THE INVENTION

Figure 1:
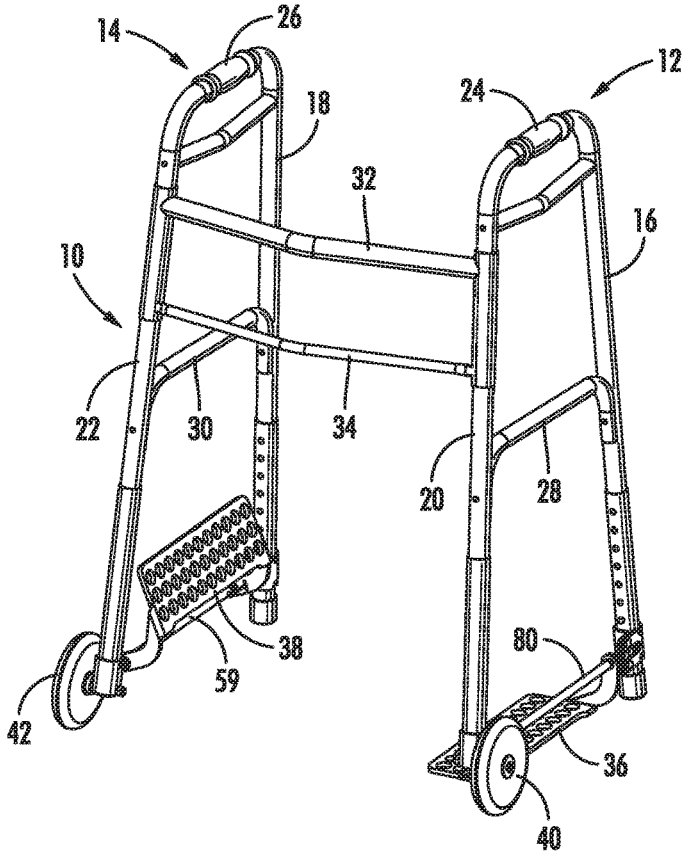
FIG. 1 is a perspective view of a specific embodiment of an improved walker constructed in accordance with the present inventions.
Figure 2:
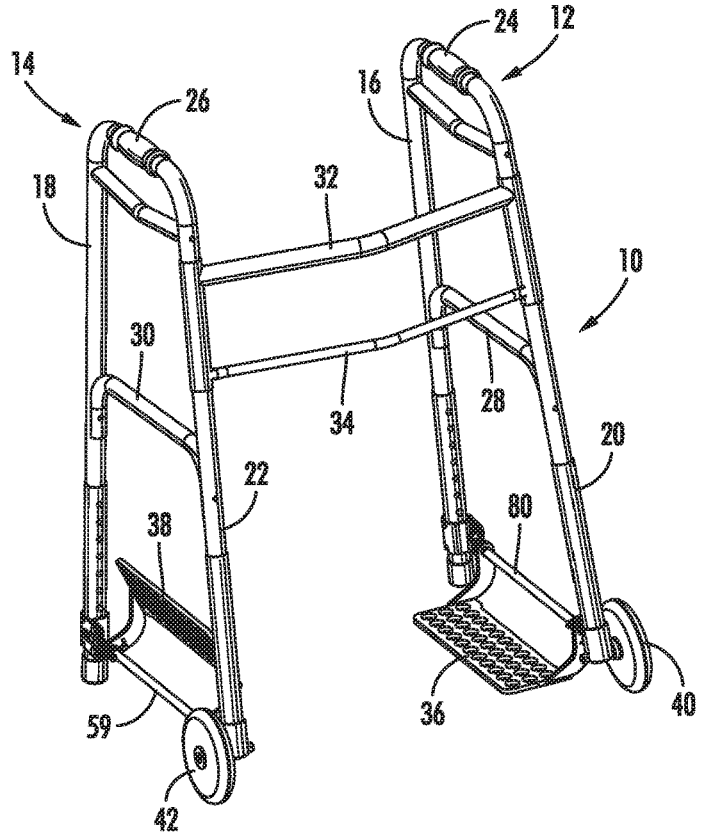
FIG. 2 is another perspective view of a specific embodiment of an improved walker constructed in accordance with the present inventions.

Referring to the drawings in detail, wherein like numerals denote identical elements throughout the several views, and referring initially to FIG. 1, there is shown a specific embodiment of an improved walker 10 comprising a left frame 12 and a right frame 14. Each frame 12/14 includes a rear vertical leg 16/18 and a forward vertical leg 20/22. Each frame 12/14 also includes a horizontal handle bar 24/26 that is preferably located about waist high from the floor. The left handle bar 24 connects the left rear vertical leg 16 and the left forward leg 20. The right handle bar 26 connects to the right rear vertical leg 18 and the right forward vertical leg 22. Each frame 12/14 may also include an intermediate horizontal support bar 28/30. The left and right frames 12/14 are connected by one or more horizontal connecting bars 32/34. The walker 10 may include left and right wheels 40/42 connected at the lower ends of the left and right forward vertical legs 20 and 22, and be situated in contact with a floor surface.

Figure 3:
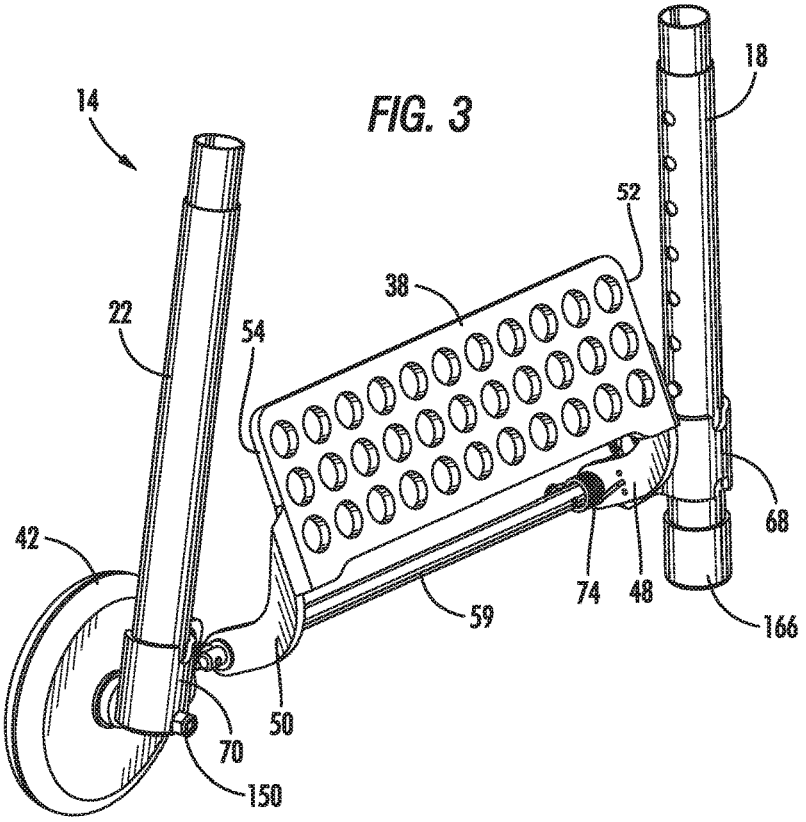
FIG. 3 is a perspective view showing a lower end of a right side of an improved walker and illustrating a rotatable foot platform in a retracted position.
Figure 4:
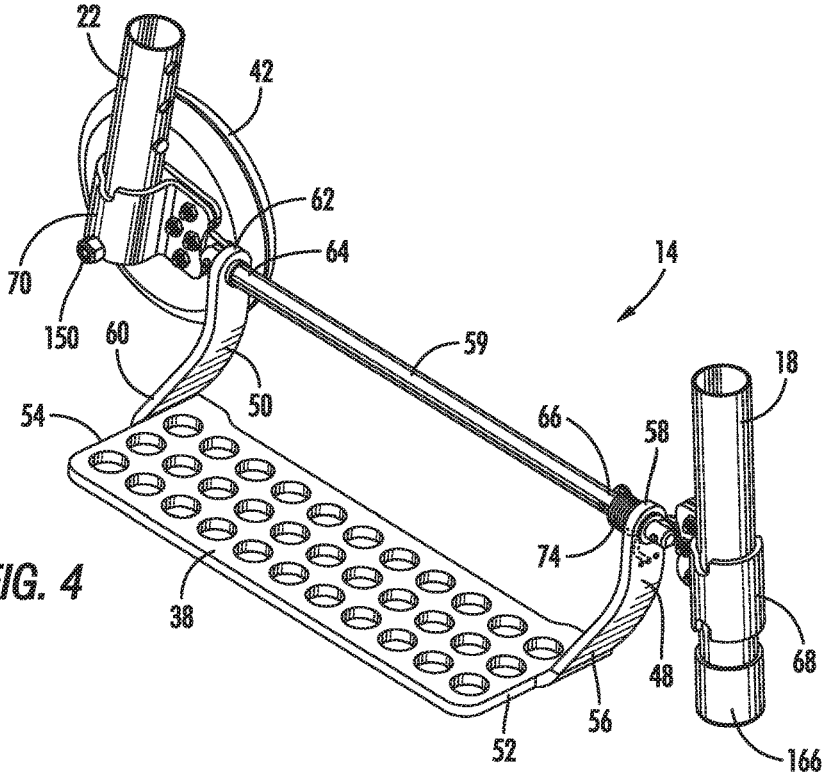
FIG. 4 is another perspective view similar to FIG. 3 except that the foot platform is shown in a lowered or engaged position in which the foot platform is resting on a horizontal floor surface.

The lower ends of each of the left and right frames 12 and 14 includes a rotatable foot platform 36/38 that is moveable between a retracted position (see foot platform 38) and an engaged position in which the platform has been rotated downwardly into engagement with the floor (see foot platform 36). The foot platforms 36 and 38 can be provided as part of a new walker or as an add-on to an existing walker. With reference to FIG. 3, an enlarged view of the lower end of the right frame 14 is shown with the right foot platform 38 in a retracted position. An enlarged view of the lower end of the right frame 14 with the right foot platform 38 in an engaged position, resting on the floor, is shown in FIG. 4. With reference to FIGS. 3 and 4, the right foot platform 38 includes a right rear arm 48 connected at a rear edge or end 52 of the right foot platform 38 and a right forward arm 50 connected at a forward edge or end 54 of the right foot platform 38. In a specific embodiment, the foot platform 38 including its rear and forward arms 38 and 50 may be stamped from one piece of material, such as metal. The right rear arm 48 includes a first end 56 connected to the rear edge 52 of the right foot platform 38 and a second end 58 rotatably mounted to a rear edge or end 66 of a right horizontal foot platform support rod 59. The right forward arm 50 includes a first end 60 connected to the forward edge 54 of the right foot platform 38 and a second end 62 rotatably mounted to a forward end 64 of the right horizontal foot platform support rod 59.

Still referring to FIGS. 3 and 4, the right frame 14 includes a right rear coupler 68 and a forward rear coupler 70 for supporting the right horizontal foot platform support rod 59. The right rear coupler 68 is connected to the lower end of the right rear vertical leg 18. The right forward coupler 70 is connected to the lower end of the right front vertical leg 22. The right horizontal foot platform support rod 59 may include a right spring 74 disposed about and engaged with the rear end 66 of the support rod 59 and also engaged with the second end 58 of the right rear arm 48 (via apertures such as those shown in an enlarged view of the left side of the walker 10 in FIG. 5, discussed below). The spring 74 functions to impart an upward rotating force to the right foot platform 38 to move it from its engaged position to its retracted position after the user removes his or her foot from the foot platform 38. In another specific embodiment, the right spring 74 may alternatively be located at the forward end 64 of the rod 59. In another specific embodiment, the walker 10 may be provided with two springs, one at the forward end 64 of the rod 59 and another one at the rear end 66 of the rod 59.

Figure 5:
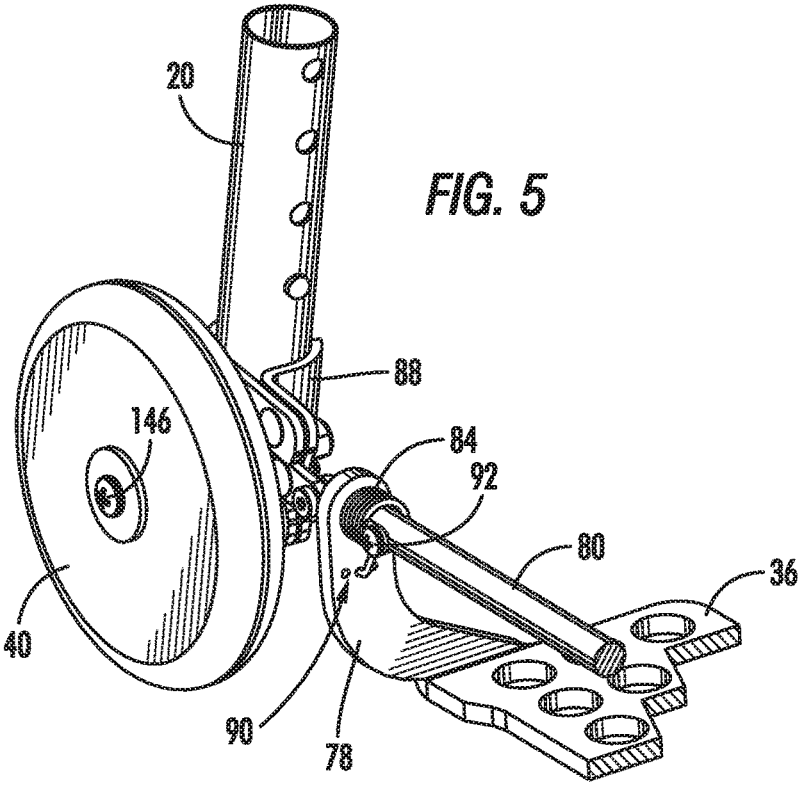
FIG. 5 is a perspective view of a lower portion of the front end of the left side of a walker as shown for example in FIGS. 1 and 2.
Figure 6:
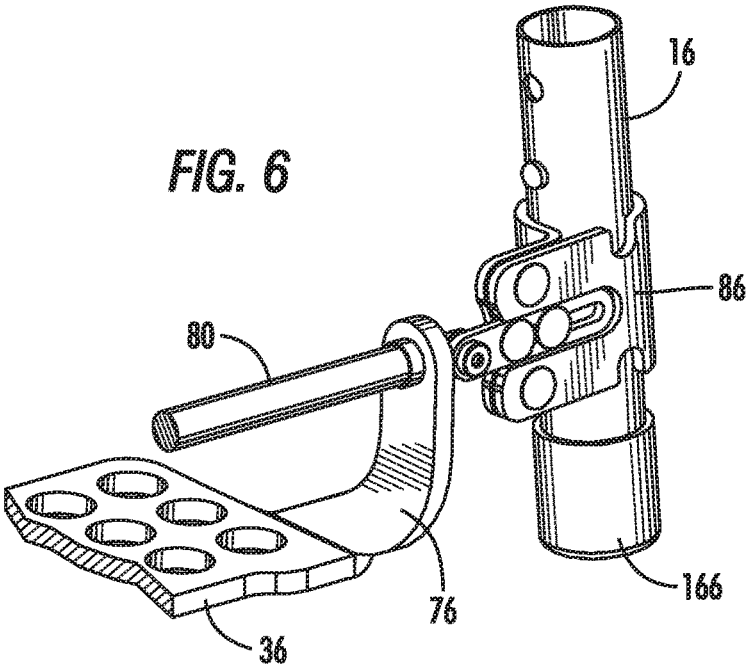
FIG. 6 is a perspective view of a lower portion of the rearward end of the left side of a walker as shown for example in FIGS. 1 and 2.
Figure 7:
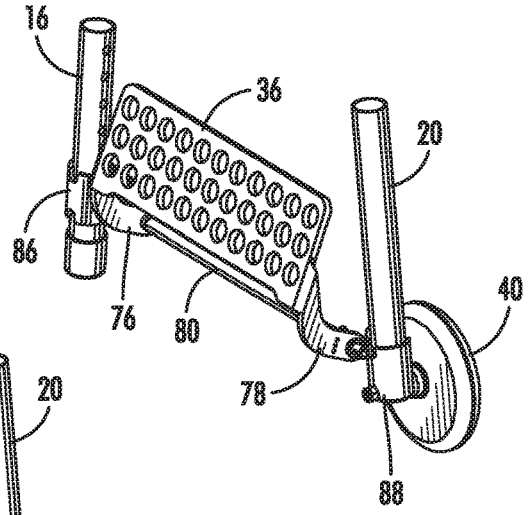
FIG. 7 is a perspective view of a lower portion of the left side of a walker with its foot platform in a retracted position.
Figure 8:
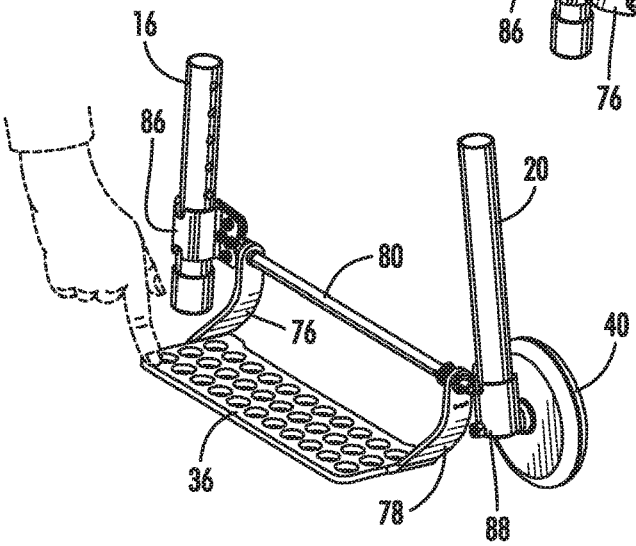
FIG. 8 is a perspective view of a lower portion of the left side of a walker similar to FIG. 7, but with the foot platform shown being lowered by a person's hand into its lowered or engaged position.

As shown in FIGS. 7 and 8, the left foot platform 36 is rotatably connected to the left frame 12 in the same way as described above with respect to the right foot platform 38 and the right frame 14. The two sides are essentially mirror images of each other. Further enlarged views showing additional details of the lower portion of the walker 10 are shown in FIGS. 5 and 6. These views are shown with respect to the left frame 12 and left foot platform 36. With reference to FIG. 5, the lower portion of the front of the left frame 12 is shown. The left foot platform 36 is connected by a left forward arm 78 to a left horizontal foot platform support bar 80. The bar 80 is connected to the lower end of the left front vertical leg 20 by a left forward coupler 88. FIG. 5 also shows that the left forward arm 78 may be provided with one or more spring engagement apertures 90 to receive and secure an end of a left forward spring 84 that is disposed about the support bar 80. It can also be seen that an opposite end of the left forward spring 84 may be connected to the support bar 80 by a screw fastener 92.

Referring now to FIG. 6, there is shown a perspective view of the lower portion of the rear of the left frame 12. The support bar 80 is shown connected to the lower end of the left rear vertical leg 16 by a left rear coupler 86. A left rear arm 76 is shown rotatably mounted to the support bar 80. The walker 10 may include a left rear spring (not shown) disposed about and engaged to the support bar 80 and also engaged to the left rear arm 76 in the same manner as discussed above with respect to the left forward spring 84. As discussed above with respect to the right side of the walker 10, in various specific embodiments, the walker 10 may be provided with a spring at the front of the bar 80 (as shown in FIG. 5), at the rear of the bar 80, or at both locations. However, only one of the spring is necessary to move the left foot platform 36 from its engaged position to its retracted position.

Figure 9:
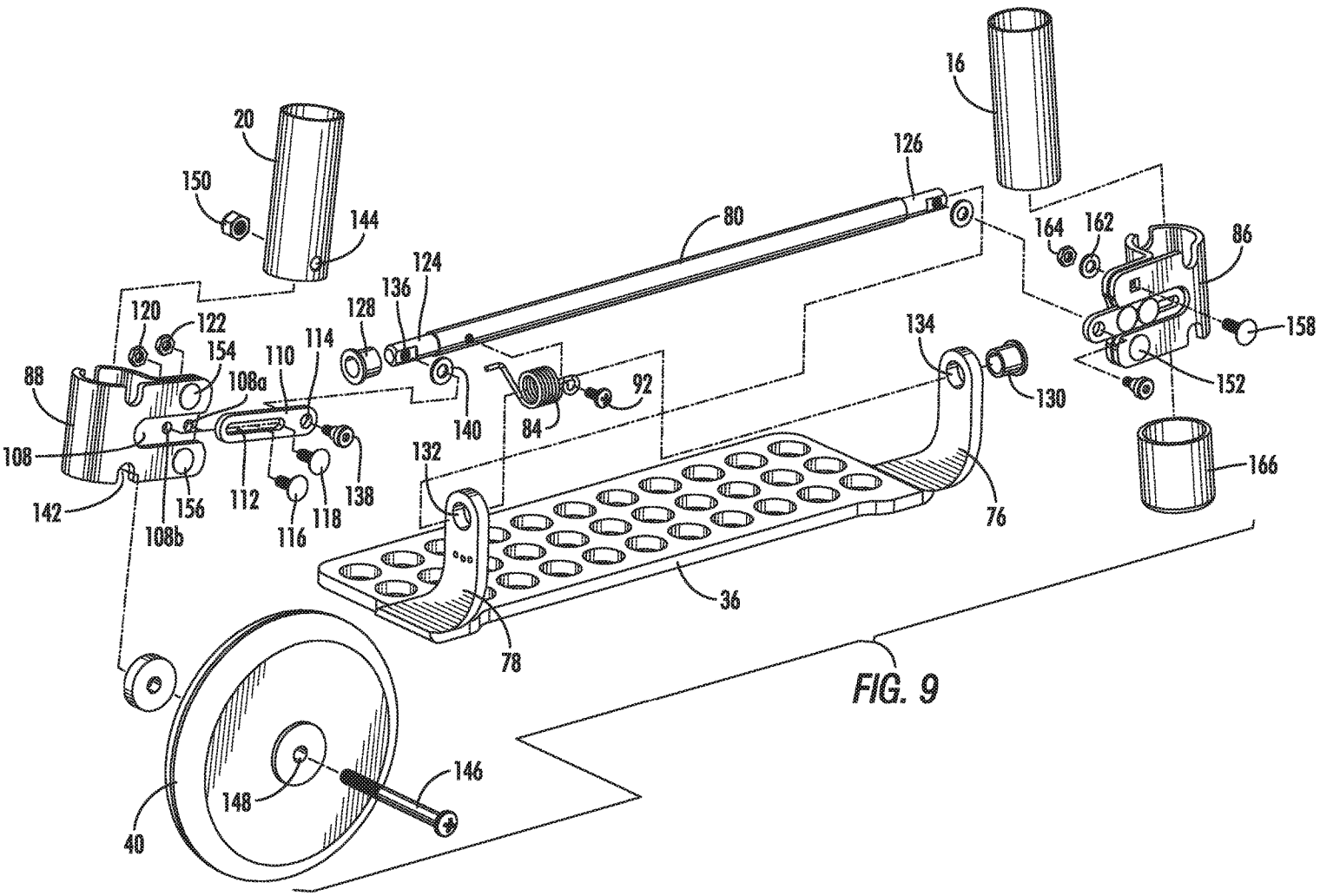
FIG. 9 is an exploded view of the lower portion of the left side of a walker illustrating the manner in which the foot platforms are rotatably attached to the lower ends of the vertical support legs, either as part of a new walker or as an add-on to an existing walker.

Referring now to FIG. 9, an exploded view is provided of the lower portion of a walker to illustrate how the various components are interconnected and the foot platform 36 is rotatably attached to the vertical legs 16 and 20. The left forward coupler 88 includes a recess 108 sized to receive a shaft bracket 110, and first and second apertures **108*a* and 108*b* within the recess 108. The shaft bracket 110 includes a longitudinal slot 112 and a shaft engagement aperture 114. When the shaft bracket 110 is positioned within the recess 108, the slot 112 is aligned with the first and second apertures 108*a* and 108*b*. Two screws 116 and 118 are provided to pass through the slot 112 and the apertures 108*a* and 108*b*, and are secured to the coupler 88 with two nuts 120 and 122. The shaft bracket 110 may be moved such as by sliding to the front and rear to its desired position, at which time the screws 116 and 118 may be tightened to secure the shaft bracket 110 in its desired position. As discussed below, the front and rear shaft brackets are connected to the support bar 80. In an embodiment in which foot platform assemblies are provided as an add-on to an existing walker, the positions of the shaft brackets 110** may be adjusted to fit the size of the walker to which it is being attached.

The support bar 80 has a first end 124 and a second end 126, each of which has a shoulder adapted for engagement with its corresponding arm 78 and 76 on the foot platform 36. A first bushing 128 is positioned within an aperture 132 in the arm 78, and a second bushing 130 is positioned within an aperture 134 in the arm 76. The first end 124 of the bar 80 is positioned through the first bushing 128 corresponding to the forward arm 78, and the second end 126 of the bar 80 is positioned through the second bushing 130 corresponding to the rear arm 76. The first end 124 of the bar 80 includes a threaded aperture 136 adapted for receiving a threaded screw 138 that is positioned through the shaft engagement aperture 114 in the shaft bracket 110 to secure the first end 124 of the bar 80 to the shaft bracket 110. A washer 140 is positioned around the threaded screw 138 and between the bar 80 and shaft bracket 110. This view also illustrates the manner in which the spring 84 is disposed adjacent the first end 124 of the support bar 80, around the support bar 80 and attached thereto with the screw 92.

The coupler 88 is secured to the support leg 20 by positioning the support leg 20 through the coupler 88 with a notch 142 aligned with a transverse aperture 144 through a lower end of the leg 20. An axle bolt 146 is positioned through a central bore 148 of the wheel 40 and through the notch 142 and transverse aperture 144 in the leg 20, and secured by a wheel nut 150. A wheel spacer 152 is also provided between the wheel 40 and the coupler 88. The coupler 88 is provided with screws 154 and 156 to securely clamp the coupler 88 to the leg 20.

The second end 126 of the bar 80 is connected to the rear coupler 86 in the same manner as discussed above with respect to the connection of the first end 124 of the bar 80 to the forward coupler 88. The rear coupler 86 is positioned around the lower end of the leg 16 and clamped thereto into its desired position using screws 158 and 160, along with washers and nuts (see washer 162 and nut 164 corresponding to screw 158). An end cap 166 is placed over the lower end of the leg 16.

Figure 10:
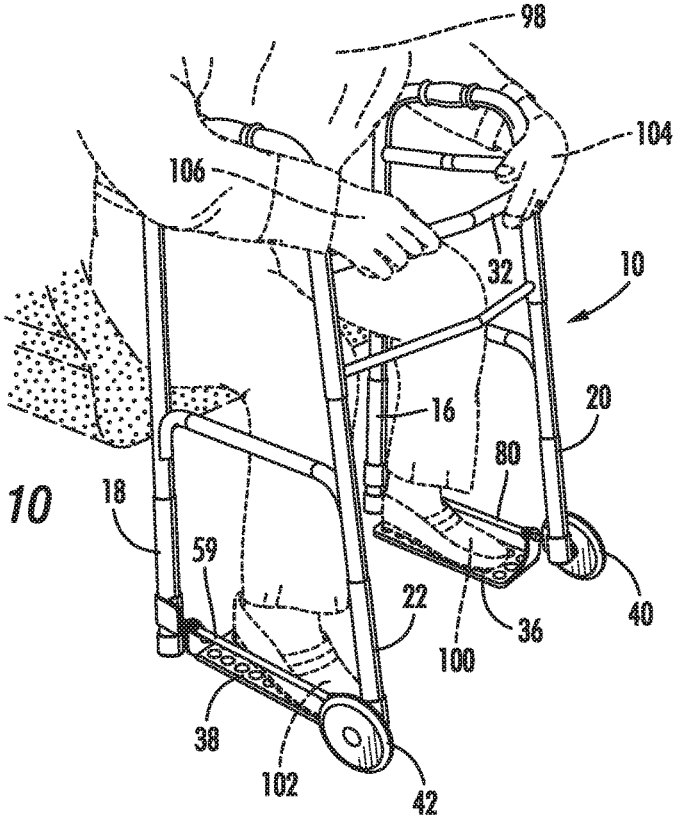
FIG. 10 is a perspective view of a person sitting in a chair with the person's feet positioned on the left and right foot platforms and preparing to move into a standing position to then use the walker.
Figure 11:
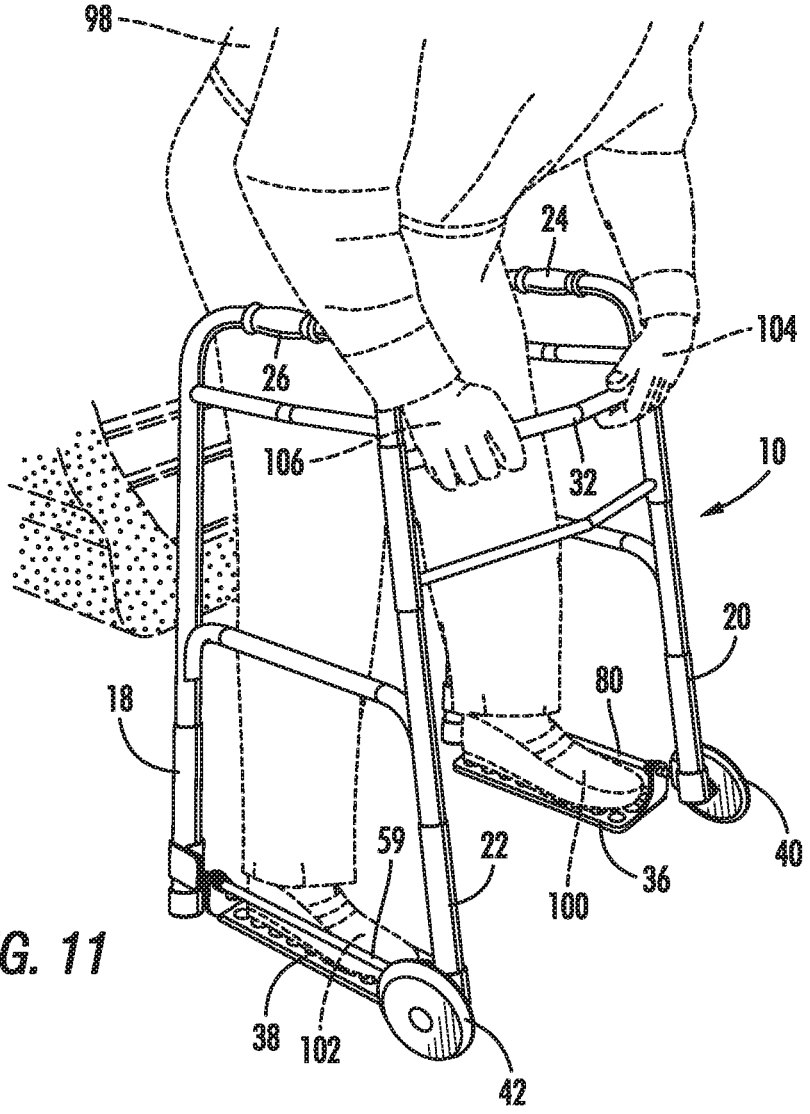
FIG. 11 is a perspective view showing the person from FIG. 10 now moved into a standing position, with his or her feet still positioned on the foot platforms, and preparing to move into a walking position and use the walker to walk.

FIGS. 10 and 11 illustrate the walker 10 in use by a person 98 in need of assistance in rising from a sitting position to a standing position to use the walker 10. In FIG. 10, the person 98 is shown in a sitting position with the person's left foot 100 resting on the left foot platform 36 and the person's right foot 102 resting on the right foot platform 38. The person 98 is leaning forward with the person's arms positioned around the outside of the upper portions of the left and right frames 12 and 14 and with the person's left and right hands 104 and 106 grasping the horizontal bar 32. By leaning forward to shift the person's weight and center of gravity onto the foot platforms 36 and 38, and by grasping the horizontal bar 32, the walker 10 becomes a much more stable structure that the person 98 can use to assist him or her in rising to a standing position.

Figure 12:
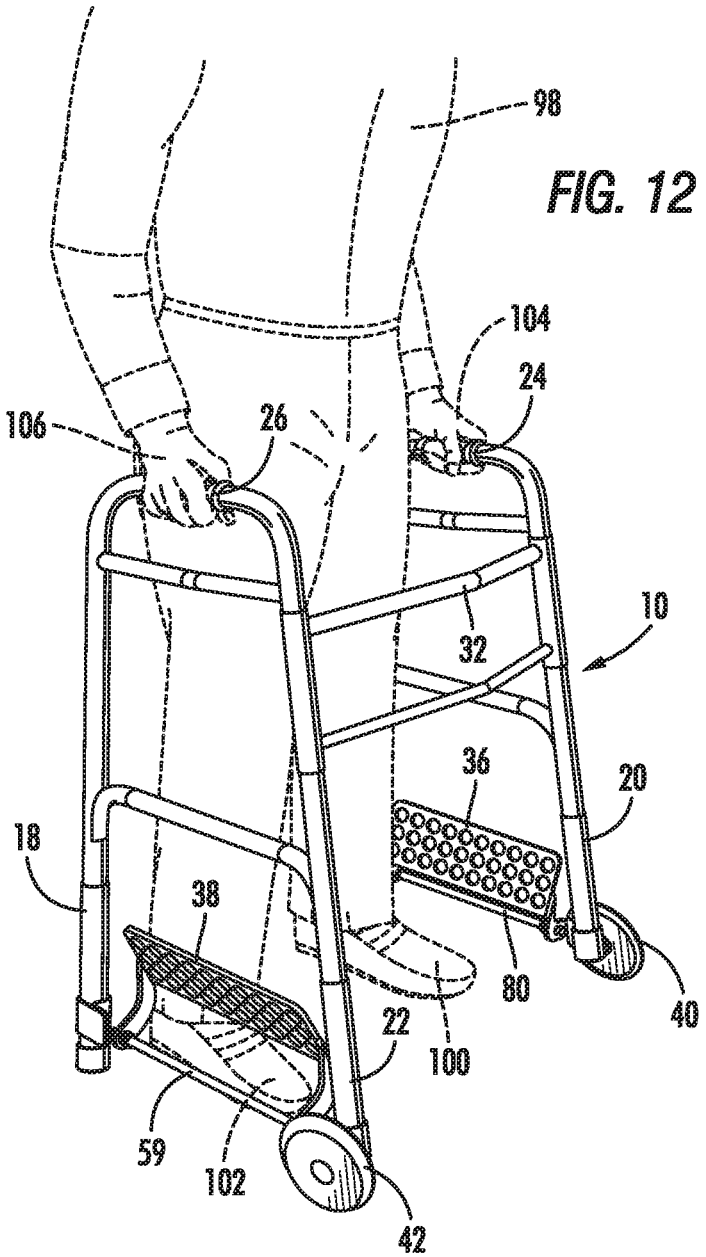
FIG. 12 is a perspective view showing the person from FIGS. 10 and 11 with the foot platforms now moved into their respective retracted positions and the person ready to use the walker to walk.

FIG. 11 shows the person 98 in a partially standing position with the person's weight positioned over the foot platforms 36 and 38 and the person's hands 104 and 106 still grasping the horizontal support 32. The person 98 can then move his or her left and right hands 104 and 106 to grasp the left and right handle bars 24 and 26 respectively. Once in this position, with reference to FIG. 12, the person 98 can then move each foot inwardly from the foot platforms 36 and 38, at which time the left and right foot platforms 36 and 38 will rotate upwardly and outwardly into their respective retracted positions under the force of the springs, e.g., springs 74 and 84.

It is to be understood that the inventions disclosed herein are not limited to the exact details of construction, operation, exact materials or embodiments shown and described. Although specific embodiments of the inventions have been described, various modifications, alterations, alternative constructions, and equivalents are also encompassed within the scope of the inventions. Although the present inventions may have been described using a particular series of steps, it should be apparent to those skilled in the art that the scope of the present inventions is not limited to the described series of steps. The specification and drawings are, accordingly, to be regarded in an illustrative rather than a restrictive sense. It will be evident that additions, subtractions, deletions, and other modifications and changes may be made thereunto without departing from the broader spirit and scope of the inventions as set forth in the claims set forth below. Accordingly, the inventions are therefore to be limited only by the scope of the appended claims.

The invention claimed is:

1. An improved walker comprising:

a left frame including a left rear vertical leg having an upper end and a lower end, a left forward vertical leg having an upper end and lower end, a left horizontal handle bar connecting the upper end of the left rear vertical leg to the upper end of the left forward vertical leg, and a left rotatable foot platform connected between the lower end of the left rear vertical leg and the lower end of the left forward vertical leg and moveable between a retracted position and a lower position in which the left rotatable foot platform is engaged with a floor surface; and a right frame including a right rear vertical leg having an upper end and a lower end, a right forward vertical leg having an upper end and lower end, a right horizontal handle bar connecting the upper end of the right rear vertical leg to the upper end of the right forward vertical leg, and a right rotatable foot platform connected between the lower end of the right rear vertical leg and the lower end of the right forward vertical leg and moveable between a retracted position and a lower position in which the right rotatable foot platform is engaged with the floor surface.

2. The improved walker of claim 1, further including a left support bar connected to the left frame and a right support bar connected to the right frame, the left foot platform being rotatably connected to the left support bar and the right foot platform being rotatable connected to the right support bar.

3. The improved walker of claim 2, further including a left spring and a right spring, the left spring being secured to the left support bar and to the left foot platform and adapted to urge the left foot platform into a normally retracted position, the right spring being secured to the right support bar and to the right foot platform and adapted to urge the right foot platform into a normally retracted position.

4. The improved walker of claim 1, further including:

a left forward shaft coupler connected to the left forward vertical leg and a left rear shaft coupler connected to the left rear vertical leg;

a right forward shaft coupler connected to the right forward vertical leg and a right rear shaft coupler connected to the right rear vertical leg;

a left support bar connected between the left forward shaft coupler and the left rear shaft coupler, the left foot platform being rotatably connected to the left support bar; and a right support bar connected between the right forward shaft coupler and the right rear shaft coupler, the right foot platform being rotatably connected to the right support bar.

5. The improved walker of claim 4, further including:

a left forward shaft bracket adjustably connected to the left forward shaft coupler and also connected to a forward end of the left support bar;

a left rear shaft bracket adjustably connected to the left rear shaft coupler and also connected to a rear end of the left support bar;

a right forward shaft bracket adjustably connected to the right forward shaft coupler and also connected to a forward end of the right support bar; and a right rear shaft bracket adjustably connected to the right rear shaft coupler and also connected to a rear end of the right support bar.

6. The improved walker of claim 4, further including a left spring and a right spring, the left spring being secured to the left support bar and to the left foot platform and adapted to urge the left foot platform into a normally retracted position, the right spring being secured to the right support bar and to the right foot platform and adapted to urge the right foot platform into a normally retracted position.

7. An improved walker comprising:

a left frame including a left rear vertical leg having an upper end and a lower end, a left forward vertical leg having an upper end and lower end, a left horizontal handle bar connecting the upper end of the left rear vertical leg to the upper end of the left forward vertical leg, a left rotatable foot platform connected between the lower end of the left rear vertical leg and the lower end of the left forward vertical leg and moveable between a retracted position and a lower position a left support bar connected to the left frame, the left foot platform being rotatably connected to the left support bar, and a left spring secured to the left support bar and to the left foot platform to urge the left foot platform into its retracted position; and a right frame including a right rear vertical leg having an upper end and a lower end, a right forward vertical leg having an upper end and lower end, a right horizontal handle bar connecting the upper end of the right rear vertical leg to the upper end of the right forward vertical leg a right rotatable foot platform connected between the lower end of the right rear vertical leg and the lower end of the right forward vertical leg and moveable between a retracted position and a lower position, a right support bar connected to the right frame, the right foot platform being rotatably connected to the right support bar, and a right spring secured to the right support bar and to the right foot platform to urge the right foot platform into its retracted position.

8. The improved walker of claim 7, further including:

a left forward shaft coupler connected to the left forward vertical leg and a left rear shaft coupler connected to the left rear vertical leg, the left support bar being connected between the left forward shaft coupler and the left rear shaft coupler; and a right forward shaft coupler connected to the right forward vertical leg and a right rear shaft coupler connected to the right rear vertical leg, the right support bar being connected between the right forward shaft coupler and the right rear shaft coupler.

9. The improved walker of claim 8, further including:

a left forward shaft bracket adjustably connected to the left forward shaft coupler and also connected to a forward end of the left support bar;

a left rear shaft bracket adjustably connected to the left rear shaft coupler and also connected to a rear end of the left support bar;

a right forward shaft bracket adjustably connected to the right forward shaft coupler and also connected to a forward end of the right support bar; and a right rear shaft bracket adjustably connected to the right rear shaft coupler and also connected to a rear end of the right support bar.

10. An assembly for attachment to a walker that includes a left frame and a right frame, the left frame including a left rear vertical leg having an upper end and a lower end, a left forward vertical leg having an upper end and lower end, a left horizontal handle bar connecting the upper end of the left rear vertical leg to the upper end of the left forward vertical leg, the right frame including a right rear vertical leg having an upper end and a lower end, a right forward vertical leg having an upper end and lower end, a right horizontal handle bar connecting the upper end of the right rear vertical leg to the upper end of the right forward vertical leg, the assembly comprising:

a left forward shaft coupler adapted for connection to the left forward vertical leg and a left rear shaft coupler adapted for connection to the left rear vertical leg;

a left rotatable foot platform adapted for rotatable connection between the left forward shaft coupler and the left rear shaft coupler, and for movement between a retracted position and a lower position in which the left rotatable foot platform is engaged with a floor surface;

a right forward shaft coupler adapted for connection to the right forward vertical leg and a right rear shaft coupler adapted for connection to the right rear vertical leg; and a right rotatable foot platform adapted for rotatable connection between the right forward shaft coupler and the right rear shaft coupler, and for movement between a retracted position and a lower position in which the right rotatable foot platform is engaged with the floor surface.

11. The assembly of claim 10, further including:

a left support bar adapted for connection between the left forward shaft coupler and the left rear shaft coupler, the left rotatable foot platform being adapted for rotatable connection to the left support bar; and a right support bar adapted for connection between the right forward shaft coupler and the right rear shaft coupler, the right rotatable foot platform being adapted for rotatable connection to the right support bar.

12. The assembly of claim 11, further including:

a left forward shaft bracket adjustably connected to the left forward shaft coupler and also adapted for connection to a forward end of the left support bar;

a left rear shaft bracket adjustably connected to the left rear shaft coupler and also adapted for connection to a rear end of the left support bar;

a right forward shaft bracket adjustably connected to the right forward shaft coupler and also adapted for connection to a forward end of the right support bar; and a right rear shaft bracket adjustably connected to the right rear shaft coupler and also adapted for connection to a rear end of the right support bar.

13. The assembly of claim 11, further including a left spring and a right spring, the left spring being for attachment to the left support bar and to the left foot platform and adapted to urge the left foot platform into a normally retracted position, the right spring being for attachment to the right support bar and to the right foot platform and adapted to urge the right foot platform into a normally retracted position.

14. The assembly of claim 11, wherein:

the left foot platform includes a forward arm and a rear arm, the forward arm of the left foot platform including an aperture adapted for receiving a forward end of the left support bar, and the rear arm of the left foot platform including an aperture adapted for receiving a rear end of the left support bar; and the right foot platform includes a forward arm and a rear arm, the forward arm of the right foot platform including an aperture adapted for receiving a forward end of the right support bar, and the rear arm of the right foot platform including an aperture adapted for receiving a rear end of the right support bar.

* * * * *